US007832132B2

(12) United States Patent
McLachlan

(10) Patent No.: US 7,832,132 B2
(45) Date of Patent: Nov. 16, 2010

(54) SIGN DEVICE

(76) Inventor: Gregory W. P. McLachlan, 2 Highfield Place, East St. Paul, MB (CA) R2E 0G3

( * ) Notice: Subject to any disclaimer, the term of this patent is extended or adjusted under 35 U.S.C. 154(b) by 293 days.

(21) Appl. No.: 12/117,013

(22) Filed: May 8, 2008

(65) Prior Publication Data

US 2008/0276506 A1 Nov. 13, 2008

Related U.S. Application Data

(60) Provisional application No. 60/916,930, filed on May 9, 2007.

(51) Int. Cl.
*G09F 13/28* (2006.01)

(52) U.S. Cl. ..... 40/550; 40/564; 40/443; 362/806; 362/812

(58) Field of Classification Search ..... 40/564, 40/550, 442, 443; 362/145, 806, 812
See application file for complete search history.

(56) References Cited

U.S. PATENT DOCUMENTS

| | | | | | |
|---|---|---|---|---|---|
| 2,496,488 | A * | 2/1950 | Ohman | 40/553 |
| 4,611,265 | A * | 9/1986 | Davis | 362/145 |
| 4,754,852 | A * | 7/1988 | Mule et al. | 181/149 |
| 4,843,525 | A * | 6/1989 | Williams | 362/157 |
| 5,073,842 | A * | 12/1991 | Monroe | 362/497 |
| 5,522,540 | A * | 6/1996 | Surman | 232/17 |
| 5,803,594 | A * | 9/1998 | Fredrickson et al. | 362/351 |
| 6,163,993 | A | 12/2000 | Boehmke | |
| 6,401,373 | B1 * | 6/2002 | Sexton | 40/576 |
| 6,568,109 | B2 * | 5/2003 | Sanders | 40/447 |
| D509,855 | S * | 9/2005 | Hilton | D20/17 |
| 2002/0122306 | A1 * | 9/2002 | O'Connell | 362/145 |
| 2004/0138768 | A1 * | 7/2004 | Murray et al. | 700/90 |
| 2004/0150522 | A1 * | 8/2004 | Krause | 340/567 |
| 2004/0201565 | A1 * | 10/2004 | Cunningham et al. | 345/102 |

* cited by examiner

*Primary Examiner*—Gary C Hoge
(74) *Attorney, Agent, or Firm*—Ryan W. Dupuis; Kyle R. Satterthwaite; Ade & Company Inc.

(57) ABSTRACT

A sign device comprises a unitary body which is fully enclosed across a top and sides of a hollow interior so as to be weatherproof. A display supported within the hollow interior is arranged to display alpha-numeric information through a translucent display portion on the front wall of the unitary body in an active state and is arranged to be not externally visible through the display portion in an inactive state. The exterior surface is textured and arranged to resemble a natural rock to further disguise the inactive display. An indicator indicates on the rear wall which one of various modes is being displayed on the front wall by the active display. The display can display an alarm condition, for example a building alarm responsive to a fire or an unauthorized entry into a building or a personal remote alarm activated by a building occupant requiring assistance.

16 Claims, 4 Drawing Sheets

SIGN DEVICE

This application claims the benefit under 35 U.S.C. 119(e) of U.S. provisional application Ser. No. 60/916,930, filed May 9, 2008.

FIELD OF THE INVENTION

The present invention relates to a sign device for displaying illuminated alpha-numeric information for example a building address or text message, and more particularly relates to a sign device which is suitable for use outdoors and which can be programmed to display different information according to different modes of operation, for example an alarm condition of a building with which the sign device is associated.

BACKGROUND

It is generally known to be desirable to display building addresses on homes and businesses to assist persons in locating the building. In displaying the address it is desirable to have an address display which is both visible at night by means of some illumination and which is sufficiently attractive when displayed during the daylight hours. Various designs of illuminated scrolling light type signs are known which are visible at night; however such signs are generally costly and unattractive in appearance.

U.S. Pat. No. 6,163,993 belonging to Boehmke discloses a simulated rock numeral display device having an LCD display for displaying prices to a customer. The display area however is very small and not well suited for being displayed from far distances as required for a building address. Furthermore the configuration of the display screen on the exterior of the device is not well suited for outdoor use in which it is desired to protect the device from the weather.

SUMMARY OF THE INVENTION

According to one aspect of the invention there is provided a sign device arranged for displaying alpha-numeric information, the device comprising:

a unitary body surrounding a hollow interior, the unitary body comprising a front wall, a rear wall spaced apart from the front wall to define the hollow interior between the front wall and the rear wall, a top wall joined between the front wall and the rear across a top of the hollow interior and end walls joined between the front wall and the rear wall along opposing ends of the front wall and the rear wall such that the hollow interior of the unitary body is fully enclosed across the top and sides of the hollow interior so as to be weatherproof;

a display supported within the hollow interior and arranged to display illuminated alpha-numeric information;

the front wall of the unitary body comprising a display portion which is arranged to be translucent;

the display being operable between an active state in which the alpha-numeric information is externally visible through the display portion of the front wall of the unitary body and an inactive state in which the display is not visible through the display portion of the unitary body.

By providing a display which is supported within the hollow interior of a unitary solid body the display is well protected from the weather for use outdoors while the exterior surface which can be textured and contoured to resemble a natural rock is attractive when displayed during daylight hours. The device can also be used during daylight hours by utilizing extremely high intensity LED's which are visible in daylight through the material forming the body.

In some embodiments the body may be formed of a material having sufficient translucence that the display may be fully contained within the hollow interior of the body to be viewable by transmitting illuminated characters on the display through the material forming the body. The display may also be operated in various modes to vary the appearance and information being displayed.

A rear indicator may be provided to display on the rear wall opposite the display on the front wall, condition or operation of the display so that the device is well suited to be positioned with the display on the forward face facing outwardly away from a building while the indicator is positioned on a rearward face facing the building so that a user can observe the condition of the display on the front surface without actually viewing the front surface while being comfortably located within the interior of the building.

In a preferred embodiment, an entirety of an exterior surface of the body is textured and is arranged to resemble a natural rock when the display is in the inactive state.

A transmissivity of material forming the display portion may be arranged to allow transmission of light from the display therethrough while arranging the light to be localized to a direct proximity to the display.

The display may comprise high intensity light emitting diodes.

The display is preferably substantially centered on the front wall to span a majority of an area of the front wall.

The display may be operable in a first mode wherein the alpha-numeric information is always visible and a second mode in which the alpha-numeric information is only displayed when the body is in substantial darkness.

The display may be arranged to display numerical address information in a first mode and display a text message in a second mode.

The display may be arranged to be activated in a first mode in which the alpha-numeric information is always displayed in a steady non-flashing condition and activated in a second mode in which the alpha-numeric information is displayed in a repeating non-steady illumination pattern.

There may be provided a ground anchor arranged to be secured in the ground and arranged to be coupled to a bottom of the body in an interlocking connection.

There may also be provided an alarm arranged to indicate an alarm condition responsive to separation of the body from a supporting surface upon which the body rests in use.

According to another aspect of the present invention there is provided a sign device arranged for displaying alpha-numeric information, the device comprising:

a body surrounding a hollow interior, the body comprising a front wall, a rear wall spaced apart from the front wall to define the hollow interior between the front wall and the rear wall, a top wall joined between the front wall and the rear across a top of the hollow interior and end walls joined between the front wall and the rear wall along opposing ends of the front wall and the rear wall such that the hollow interior of the body is fully enclosed across the top and sides of the hollow interior;

a display supported within the hollow interior of the body and arranged to display illuminated alpha-numeric information on the front wall of the body in a plurality of different modes; and an indicator arranged to indicate on the rear wall which operating and display mode is being displayed on the front wall by the display.

Selection between the different modes is preferably arranged to be accomplished by a remote controller arranged to communicate with the display through the rear wall of the unitary body.

When there is provided an indicator arranged to display a plurality of different colours, each mode of operation of the display on the front wall is preferably associated with a different one of the colours or mixture of colours arranged to be displayed by the indicator on the rear wall.

According to another aspect of the present invention there is provided a sign device arranged for displaying alpha-numeric information, the device comprising:

a body surrounding a hollow interior, the body comprising a front wall, a rear wall spaced apart from the front wall to define the hollow interior between the front wall and the rear wall, a top wall joined between the front wall and the rear across a top of the hollow interior and end walls joined between the front wall and the rear wall along opposing ends of the front wall and the rear wall such that the hollow interior of the body is fully enclosed across the top and sides of the hollow interior; and a display supported within the hollow interior of the body and arranged to display illuminated alpha-numeric information on the front wall of the body;

the body being arranged to be supported externally from a building with which the display is arranged to be associated; and the display being arranged to display an alarm condition on the front wall of the housing responsive to an alarm trigger within the building.

The alarm trigger may comprise a building alarm arranged to determine the alarm condition responsive to a fire or an unauthorized entry into the building, or a portable remote arranged to be carried by an occupant of the building.

The alarm trigger may further comprise an interface arranged for connection to a building alarm of a building in which the interface has an auxiliary switch and is arranged to determine the alarm condition responsive to an alarm condition of the building alarm or responsive to activation of the auxiliary switch by an occupant of the building.

Some embodiments of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
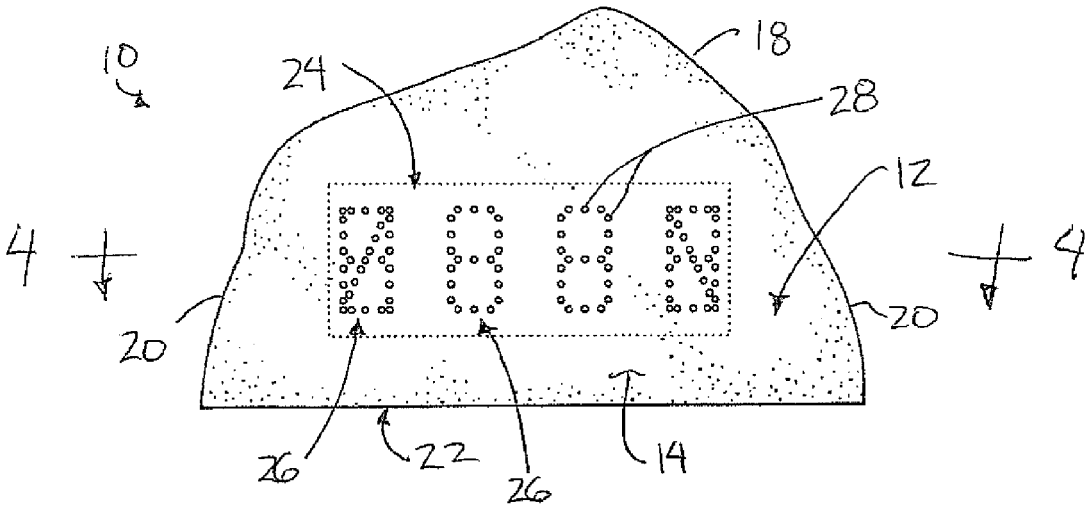
FIG. 1 is a front elevational view of the device.
Figure 2:
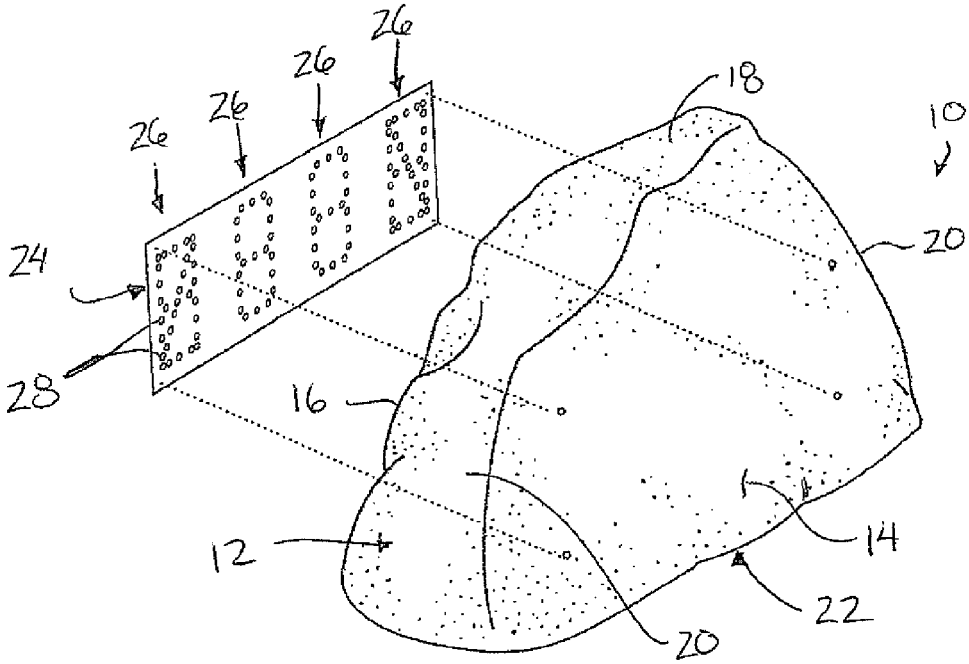
FIG. 2 is a partially exploded perspective view of a front side of the device.
Figure 3:
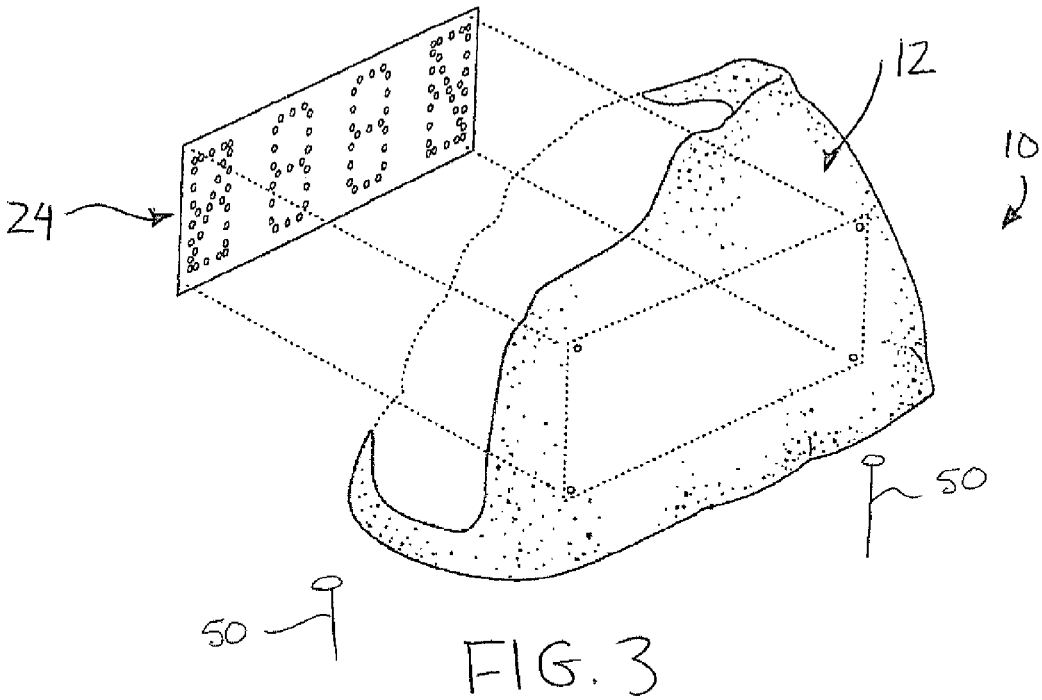
FIG. 3 is a partly sectional exploded view of the device in perspective.
Figure 4:
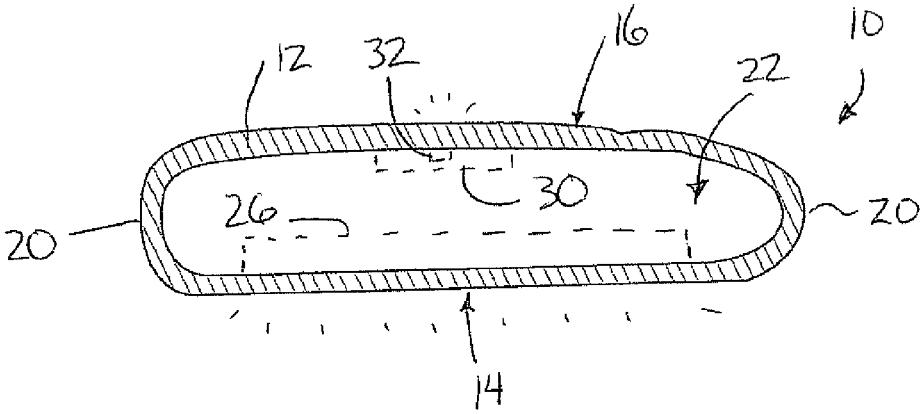
FIG. 4 is a sectional view along the line 4-4 of FIG. 1.
Figure 5:
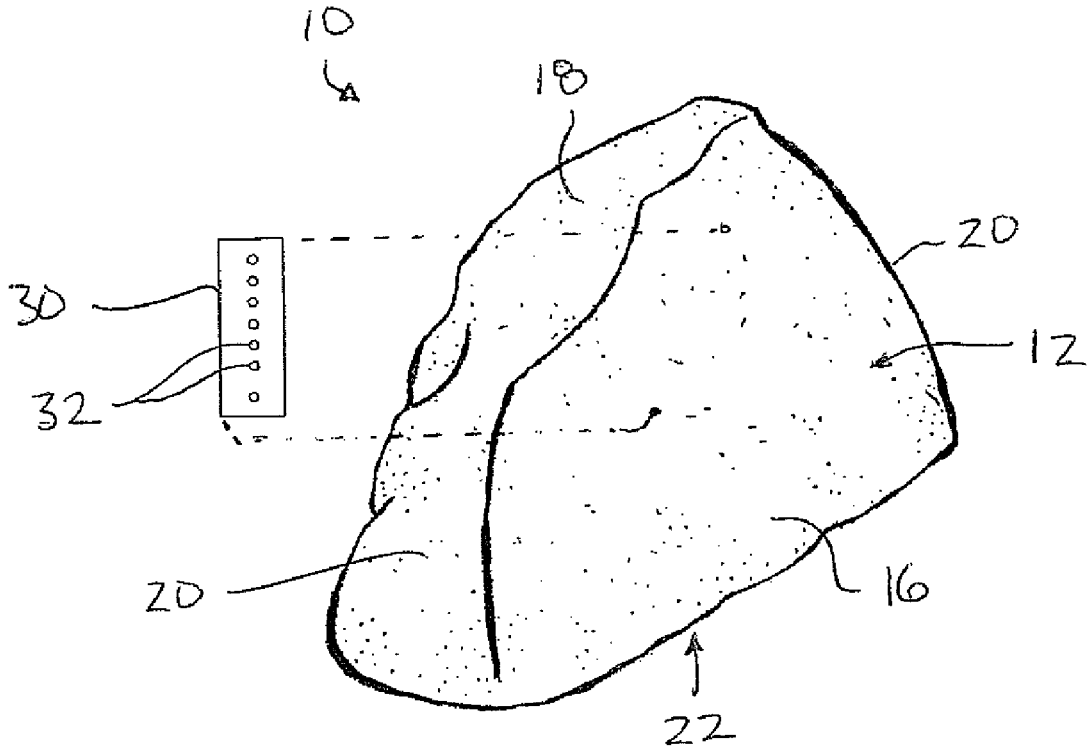
FIG. 5 is an exploded perspective view of a rear side of the device.
Figure 6:
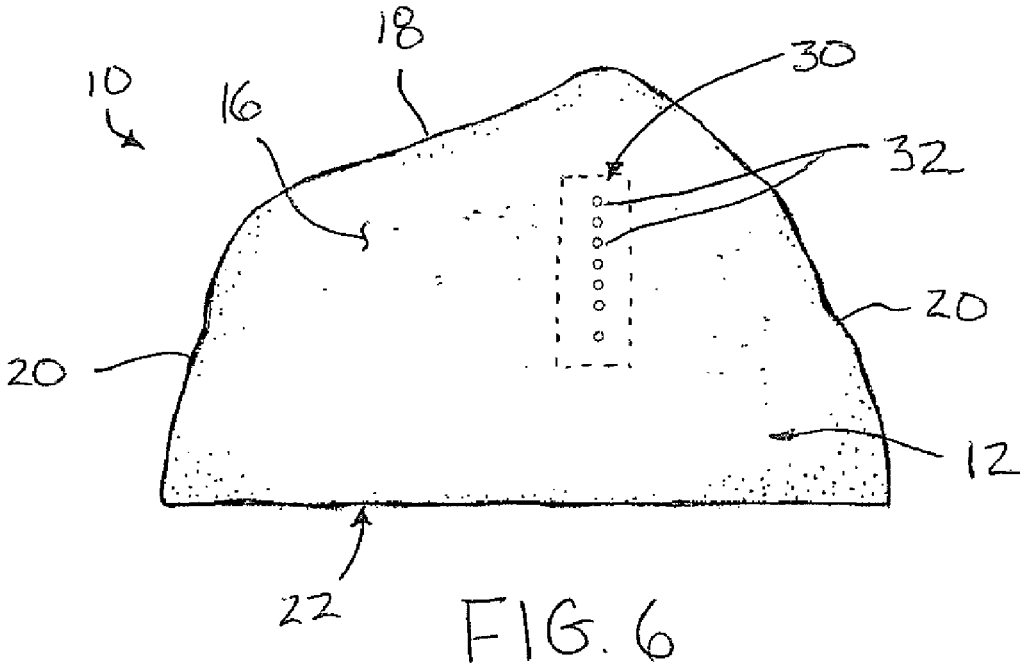
FIG. 6 is a rear elevational view of the device.

Referring to the accompanying figures there is illustrated an illuminated alpha-numeric sign device generally indicated by reference numeral 10. The device 10 is particularly suited for simulating the appearance of a rock to disguise the information to be displayed when desired while displaying numerical address and text message information thereon.

The device 10 includes a unitary body 12 having a front wall 14 and a rear wall 16 which are arranged to be supported in an upright orientation generally parallel and spaced apart from one another to define a hollow interior therebetween. The front wall and the rear wall are joined by a top wall 18 spanning between the tops of the front wall and rear wall across a top of the hollow interior, and end walls 20 spanning between the front wall and the rear wall at opposing ends thereof. An open bottom 22 of the body 12 is generally flat and provides access to a hollow interior of the body. The hollow interior of the unitary body is thus fully enclosed across the top and sides of the hollow interior so as to be weatherproof.

The body in the illustrated embodiment is moulded as a unitary and integral piece of polyethylene or other suitable plastic type material which can be readily moulded. The material forming the body is somewhat translucent and is arranged to have the general appearance of being opaque with a texture and colour which simulates a natural rock. The contour of the body is irregular in shape to further resemble a natural rock.

A display 24 is supported within the interior of the body and is arranged to output illuminated alpha-numeric information to be displayed on the front wall 14. The display includes four alpha numeric digits in the illustrated embodiment but can be expanded to additional digits. The digits are suitably sized to collectively substantially span a majority of the front wall while being centered in relation to the base, top and end walls. The front wall is fully sealed across the display to protect the display within the hollow interior from the weather and elements.

Each of the digits 26 of the display is formed of a plurality of high intensity light emitting diodes (or LED's) 28. The material forming the body has a sufficient degree of translucence when provided of consistent thickness throughout the body so that the light emitted from the diodes is arranged to be transmitted through a display portion in the front wall of the body in alignment with the display 24 to be externally visible on the front wall in an active state of the display. When the display is turned off into an inactive state however, the body at the display portion is sufficiently opaque that the display is not visible through body.

The external surface of the body, which resembles a rock, fully spans across the display portion to fully disguise the display across which the display portion of the housing spans such that the display is no longer visible and also resemble a rock in the inactive state. The material forming the body has a suitable transmissivity of light so that the light being transmitted by each LED from the display through to the front wall exterior is sufficiently localized to the immediate proximity of the LED adjacent the inner surface of the front wall. The remainder of the body other than the display portion spanning across the display 24 can vary in thickness and translucency relative to the display portion without affecting the function of the display being either visible or hidden at the front wall of the body.

The device also includes an indicator 30 supported in the hollow interior on the inner side of the rear wall 16 in the form of a plurality of indicator lights 32 which are each of different colour. Each of the different coloured one of the indicator lights 32 is arranged to display a different mode of operation or a different condition of the information being displayed on the display 24 in communication through the front wall of the body. Combinations of modes can be indicated or displayed by illuminating an appropriate combination of the indicator lights 32. A rear display portion is provided in the rear wall of the body to span across the indicator 30 which has similar characteristics to the display portion in the front wall so that the indicator is similarly transmitted through the rear display portion when active or is hidden when inactive.

The various modes in which the display can be operated in the active state include a normal mode in which numerical address information is displayed in a steady on condition to be illuminated at all times. Alternatively the display can be operated in an automatic mode in which the display is only illuminated at night using a daylight sensor and suitable control switch. When the display is illuminated, it can be illuminated in a steady non-flashing mode, a flashing mode, and a wipe mode in which each of the digits 26 is illuminated sequentially before all being turned off and then subsequently being illuminated sequentially once again in a continuing cycle. Various other active on and off patterns of the digits can be programmed if desired.

In yet another mode, the numerical address information can be replaced with a text message, for example the word open may be continuously displayed for a business by manual activation.

Alternatively a text message such as the word "HELP" may be displayed upon actuation by a user desiring assistance of some form. The help message can be triggered by a pull cord type emergency switch within the interior of a building 34 with which the device is associated, or by a portable personal alarm remote carried by an occupant of the building which requires assistance or by interaction of the device with a building alarm 36 associated with the building.

When used with a building alarm 36 of the type which determines an alarm condition responsive to a fire or unauthorised entry into the building, the alarm condition can be displayed on the device 10 by use of an interface 38 which connects to the building alarm 36 and relays the alarm condition to the display 24 of the device. The interface 38 may also be provided with an auxiliary actuation switch, for example a pull cord type device which can be actuated by occupant of the building which requires assistance instead of a portable personal alarm remote carried by the occupant. The auxiliary actuation switch similarly relays an alarm condition to be displayed on the display 24 of the device.

The display can also be operated in various combinations of modes. For example, a numerical address or a text message can be illuminated to be flashing or non-flashing, and can also be operated to remain on during daylight or be illuminated only in darkness.

Generally all functions of the device are preferably controlled with mode selection being accomplished through the use of a remote controller 40 so that the operation and condition of the device can be modified when the device is located outside of the building with the front wall facing away from the building and the rear wall facing the building. In the illustrated embodiment, the remote controller includes P/Adv or programming button 42, a Op/Adv or operation button 44, a help or test button 46 and a set button 48 including right and left sides which can be individually activated. Function of the various buttons is described further below.

Accordingly the user wishing to program the device or change the mode thereof for instance can do so by staying within the building and observing the rear face of the device through a window in the building whereby the indicator 30 on the rear wall indicates condition of the display to the user and the user can change the information being displayed using the remote.

A further option includes also displaying help or alternatively displaying an alarm condition upon automatic activation by a trigger which is interfaced with a building alarm of the building with which the device is associated. Accordingly if anything activates the building alarm in the usual manner for example a fire or an unauthorized entry into the building, the corresponding trigger automatically and responsively causes the alarm condition to be displayed on the device to people on the exterior of the building.

To secure the device to the ground in a yard of the building, externally and separate from the building, ground anchors may be inserted into the ground with which the base of the device will be interlocked. Interlocking engagement preferably includes a laterally sliding movement to make removal of the device from the ground more difficult. Removal of the device from the base may sound an alarm when an optional anti-theft alarm unit is included.

Figure 7:
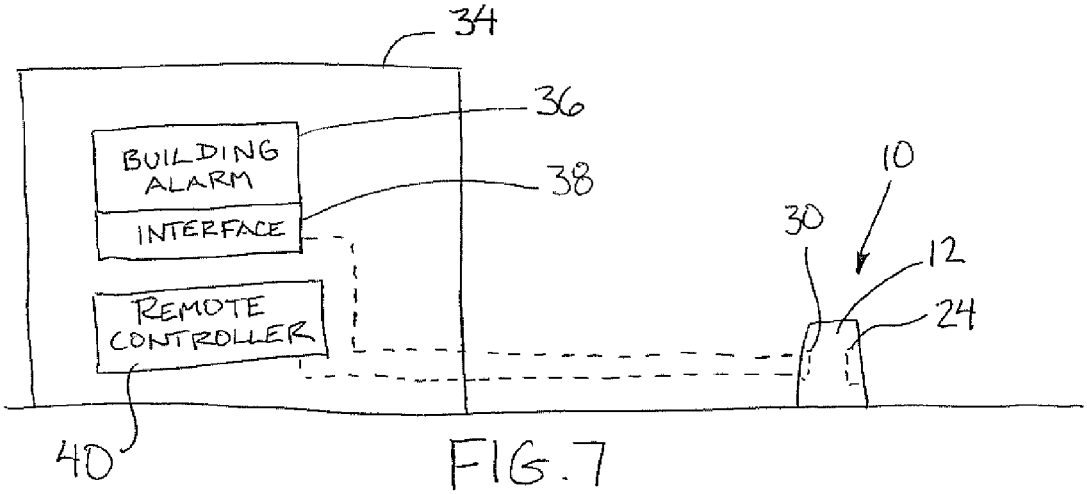
FIG. 7 is a schematic representation of the device associated with a building having a building alarm.
Figure 8:
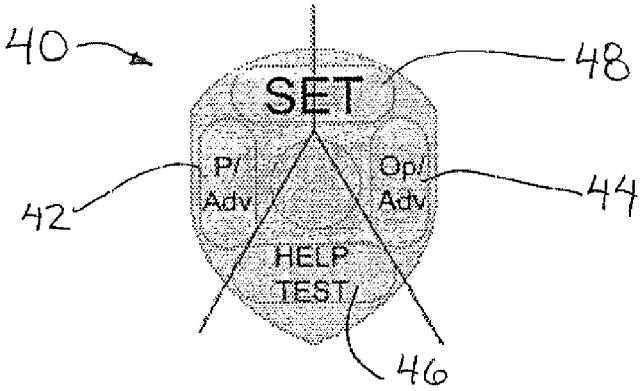
FIG. 8 is a plan view of a remote controller for programming and operating the display.

As described herein a complete system is made up of the following components: a unitary body locating the display 24 and indicator 30 therein which are powered through an A.C. adapter and an underground electrical cable to an associated building 34, a 4 button Keyfob remote controller 40, and a Security System Interface Unit (SSIU) shown in FIG. 7 as interface 38.

The body 12 displays on the front wall a 4 digit preprogrammed Address or selected O-P-E-N message in one of three user selectable display modes (Normal, Flash or Wipe). The display 24 will also display an emergency H-E-L-P message when receiving an emergency "help" signal from SSIU interface representing an alarm condition. A user initiates this signal by pulling out an emergency "help" cord on the SSIU. A user can "test" the ability of the display to display the emergency help message by pressing the "help test" button on the remote.

The display will also display an emergency A-L-A-R message when receiving emergency "alarm" signal corresponding to an alarm condition from the SSIU through an existing residential or commercial alarm system interfaced or connected to the SSIU alarm input. When displaying emergency H-E-L-P or A-L-A-R messages, the message will typically flash three times then display the preprogrammed address, then repeat until the emergency or HELP alarm situation has ceased. This is performed to: a) alert the user that an intrusion of their commercial or residential property has taken place before entering what may be a dangerous situation; b) inform others of the exact address location where police, emergency or first responder personnel should be directed to; and c) indicate visually to police, first responders or others the exact location without the need to search for the exact address. The device is extremely helpful at night since every second counts.

The indicator on the rear face comprises a column of light emitting diode (l.e.d.) indicators to indicate the status, display & operating modes selected by the user. The indicator is used in conjunction with the remote to select the display & operating modes of the receive display rock feature. Status, display & operating mode information is color coded for easy identification at the rear of the body which faces the building associated with the device.

The 4 button Keyfob or remote controller 40 is used to select & program (in conjunction with the 4 digit address display on front of rock feature or body 12), the user's address into non-volatile memory for display on the front of the rock feature or body 12. It is also used to select (in conjunction with the rear mounted status, display & operating modes indicator) & program the display & operating modes into non-volatile memory.

The interface 38 or Security System Interface Unit interfaces with a preexisting commercial or residential alarm system. The alarm system can supply the SSIU with an alarm condition and the SSIU then sends an emergency alarm signal to the display 24 to display the emergency alarm message interspersed with users address.

A user can initiate the sending of the emergency help signal from the SSIU to the receive display rock feature (body 12) by pulling out the emergency "help" pull cord on the interface. An emergency Help message is then displayed interspersed with user's address.

The rock feature or body 12 comes with ground pins 50 that are used to hold the rock feature securely to the ground. A ground pin template is supplied that ensures proper placement of the mushroom shaped ground pins so they line up with mating holes in the bottom of the body. The ground pins must be hammered into the ground leaving the bottom of the mushroom head approximately ¼ inch above ground level. The rock feature (body 12) is then placed over the mushroom head ground pins making sure the heads are inserted through the mating holes in the bottom of the body. Once this is completed the rock (body 12) is displaced in a lateral sliding movement until the rock cannot be pushed any farther for interlocking engagement between the ground pins and the body which resists upward displacement of the body away from the ground pins and ground within which they are secured. At this point the mushroom heads are holding the bottom of the rock feature securely to the ground. To test installation it should be difficult to pull the rock feature in an upward direction. Removal of rock feature is the opposite of installation.

In preparation for the next step for installation of the rock feature or body 12, the body 12 is removed from the pins 50 and placed beside the ground pins so that power can be connected to the internal components of the device. Before connecting the power cable to the body of the device, an underground cable is arranged to extend underground from the a.c. adapter plugged into grid power at the associated building 34 to the desired installation location of the body 12.

Accessible through the open bottom of the body, there is provided 2 electronic boards inside the hollow interior of the body. A larger electronic board mounted on the front corresponds to the display 24 and a smaller electronic board corresponds to the indicator. The cable is connected to a suitable power jack that will accept the power plug at the end of the included cable. The cable should be buried in the ground to a depth of approx. 8 inches or greater.

Most if not all hard-wired & wireless residential or commercial alarm systems include an auxiliary output that will turn on a burglar bell (or siren) or other device connected to this output. This output is accessible to the user & is usually configured to supply 12 volts when enabled during an actual alarm condition or 0 volts when there is no alarm condition. For the SSIU interface 38 to be able to command the display to display the alarm message (A-L-A-R) interspersed with the user's address the SSIU must access & be connected to this auxiliary output on the building alarm 36.

The steps for connecting the SSIU to the Alarm system auxiliary or Burglar Bell (or siren) output follow:

1) Install the SSIU as close to your alarm system as possible while being able to plug in the a.c. Adaptor. The alarm interface plug comes with 2 wires already stripped & installed to go to the switched auxiliary or Burglar Bell (siren) output & the ground (alarm system ground or reference).

2) Identify from your Alarm system's manual (or installer manual) which auxiliary or Burglar Bell (or siren) output is available. Ensure that this output will switch to 10-14 volts d.c. when the alarm system is in alarm condition with respect to ground & remains at this voltage for the duration of the alarm situation. Alternatively, this output may have to be reprogrammed to stay active for the duration of the alarm condition, before being disarmed. This is the positive switched input that will be connected to the SSIU thru a SSIU plug of the interface 38.

3) Insert the SSIU plug into its jack on the SSIU. This connects your alarm system's auxiliary or Burglar Bell (or siren) to the SSIU.

4) Proceed to test the alarm system.

5) Plug in a supplied a.c. adaptor (9 volts/100 ma).

6) Plug in a pull for HELP plug if not installed.

The 2 main functions of the keyfob (remote controller 40) of selecting & programming of the address & selection & programming of the display & operating modes, are divided into the left side & right side keys respectively. The left side buttons include the P/Adv (address, program, advance) button 42 & left side of the set button 48. The right side buttons include the Op/Adv (Operating Modes, program, advance) button 44 and the right side of the set button 48. The set button is used to store the selected address digit when in the address programming routine or the selected operating mode when in the display & operating mode programming routine.

Address Selection Programming

When selecting & programming an address into the device 10, the user should be facing the front wall of the device so that the 4 address digits are clearly visible when in front of the front wall. Pressing the P/Adv button 42 for the first time, will put the system into the address selection & programming routine. The 4 digit display will clear & only the left most digit of the 4 will be lit up with a "0" displayed. If the P/Adv button is released after putting the unit into the address selection & programming routine, after a short delay the unit will recommence displaying the previous 4 digit address or open message in whatever display mode was previously selected. If the P/Adv is held down the leftmost digit will start advancing this digit through all decimal digits from "0" to "9", then a dash (-) & then the letter (b) for a blank digit. There is a short delay between successive incrementing of the digits. The user advances incrementally through the digits & the 2 characters (- & b) until the desired digit is reached. The user must release the P/Adv button when the digit has reached the desired number or character. The desired number or character will remain displayed for a short time whereby the user can program this selected number or character into memory for that digit. To do this the user must press the SET button. Once the user presses this button the unit will store the selected number or character into memory. The unit lets the user know that it has stored the selected number or character for that digit by moving to the next digit to the right & displaying the number "0". Again, pressing the P/Adv will cause this digit to advance incrementally to the next number or character. Once the desired number or character has been reached the P/Adv button must be released & the SET button again pressed to place this number or character in memory for this second digit. This procedure is repeated for all 4 digits. Once completed, the new address will be displayed in whatever display mode has been previously selected.

Display & Operating Mode Selection/Programming

The method by which this unit can display an address or the O-P-E-N message is user selectable & can be in one of 3 ways. The 3 display modes available are: Normal Display Mode, Wipe Display Mode and Flashing Display Mode.

Normal Display Mode

When the Normal display mode has been selected, all digits are continuously on (lit up) & display the last selected & programmed address or the 0-P-E-N message.

Wipe Display Mode

When the Wipe display mode has been selected, the display will turn on (light up) the left most digit first. This digit will stay on (for a short time) & display whatever the first address digit was programmed as or the letter "O" (NOT the number "0") if the O-P-E-N message was selected to be displayed instead of the user's address. After a short delay, the first & second digit will be turned on (lit up). One would see the first & the second digit of the pre-stored address or the 0-P if the open message was selected. After another short delay the first, second & third digit will be turned on (lit up). One would now see the first 3 address digits or 0-P-E if the open message has been selected. After another short delay, all 4 digits of the address or all 4 letters of the O-P-E-N message will be displayed. After another short delay, the display is blanked & the process repeats itself continuously. The overall effect is to see the 4 digit address or the OPEN message scroll across from left to right like it was "wiped" across the display.

Flashing Display Mode

The Flashing display mode involves flashing the display. Selection of this display mode causes the 4 digit display to flash the pre-selected address or OPEN message continuously.

Not only can the user select the display mode there are 2 operating modes that can also be selected. These are: Auto/Manual Mode or O-P-E-N Message Mode.

Auto/Manual Mode

If the auto mode is selected, the unit will only turn on (light up) the 4 digit display when it is dark. If the auto mode is NOT selected; the unit will automatically default to the manual mode of display operation (display will be on (lit up) continuously whatever the light level.

O-P-E-N Message Mode

If the OPEN message mode is selected the unit will display the O-P-E-N message instead of the user's address in whatever display mode was previously selected. To revert back to displaying the address, the open message mode must be deselected & will default to address mode display.

Status, Display & Operating Mode Indicator

Figure 9:
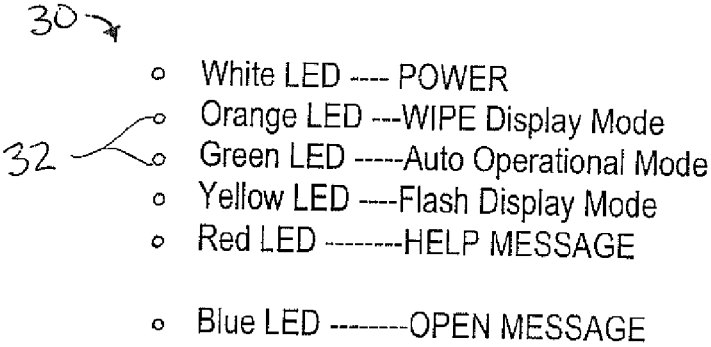
FIG. 9 is a schematic representation of the indicator on the rear wall of the device.

On the back of the body 12 there is a row of 6 differently colored LED Indicators. Present operational status, display & operating mode settings are indicated to the user through these differently colored indicators and are used in conjunction with the Keyfob remote controller 40 to change the display and operating modes. The indicators are visible to the user from the back or rear side of the body 12 which will be facing the user's residence or commercial building & can be changed by viewing the indicators through a window. The differently colored LED's & the status, display or operational modes they correspond to are represented schematically in FIG. 9.

Using the 4-Button Remote Controller to Select & Program the Display & Operating Modes When selecting & programming the display & operating modes a user should be facing the back or rear wall of the body 12 so that the status, display & operating mode indicator is visible to the user. To put the unit into the display & operating mode select & programming routine a user presses the right side button on the Keyfob remote controller 40 marked Op/Adv & then release this button. After pressing this button all indicator lights will flash rapidly five times to indicate that the unit is now in the display & operating mode selection & programming routine, then will turn on (light) the orange indicator led. All other indicators are turned off at this time. The unit at this point is asking if the user would like the Address (previously programmed) or OPEN message to be displayed in WIPE display mode. If this display mode is desired it is necessary for the user to press the set button.

Pressing the set button causes the WIPE mode to be saved in memory. The unit will acknowledge to the user that it has stored this selected display mode by turning the orange indicator off & turning on the green indicator LED. If the WIPE display mode is not desired, the Op/Adv button should be pressed once to advance to the next display or operating mode selection which happens to be the Auto Operational Mode. As mentioned previously, selecting this mode causes the unit to display the user's address or OPEN message only if it is dark. So, if it is desired that the unit ONLY displays an address or the open message when it is dark this must be selected & stored (SET) into memory. To do this, the SET button is again pressed.

The unit will acknowledge that it has stored a selection by advancing automatically to the next display or operating mode selection. If you want the display to be on all the time (dark or light) then the user simply presses the Op/Adv to advance to the next display or operating mode selection. At this point one of two things will happen as follows.

If the user did NOT previously select & program (SET) the WIPE mode of display then the Yellow led indicator will be turned on (lit up). The routine is asking the user if they would like to select the Flashing Mode of display (since the user did not previously select the WIPE mode). If the user had previously selected the Wipe mode, then the indicator will NOT turn on the Yellow indicator LED (as the user has already selected & SET the device to the WIPE mode) but will "Jump" to the Blue Indicator LED which is the lowermost LED.

The indicators will have made a jump over the Yellow & Red Indicator LED's in the top to bottom sequence & will then turn on the Blue LED indicator. If the user did NOT select the WIPE display mode then the Yellow led indicator will be turned on (lit up).

The routine is asking the user if they would like to select the Flashing Mode of Display. If so, the user simply presses the SET button (again). The address or open message will be displayed in a flashing fashion as previously described. If the user does not want to select the Flashing display mode, the user presses the Op/Adv button to advance the LED indicator to the last operational mode selection. The Blue LED indicator will then be turned on (lit up).

The activation of the Blue LED indicator is how the device asks the user if they would like the OPEN message to be displayed instead of the user's commercial or residential address. If so, the user presses the SET button & the unit will display the OPEN message instead of the user's address.

To indicate to the user that the Display & operational mode selection & programming routine is finished (& to store all selected settings), the LED indicator will again flash rapidly five times then return to displaying the user's address or OPEN message.

If the user has NOT selected either the WIPE or Flash display mode the unit will display in Normal Mode as previously described. The Normal Display Mode is the Default Mode of Display for this unit. The Red LED indicator is NOT used to set a display or operating mode but is used to indicate to the user that the emergency HELP message is being displayed on the front of the body 12. The Red LED provides status information regarding whether or not the emergency HELP message is being displayed.

Once the user has completed selecting & programming the display & operational modes, each individual selected display & operational mode led indicator will flash to inform (continuously) the user as to which modes & settlings the unit is presently operating with.

A user can test the emergency HELP function (similar to testing if your smoke alarm is working) by pressing the HELP TEST button on the remote controller 40. If the user is watching the LED indicators at the back or rear of the body 12 the user will see the red led status indicator flash 3 times every time it displays the HELP message on front of body 12 & the address information. Holding the HELP TEST button down will cause the display to continuously display the HELP message & flash the red led status indicator. Releasing the HELP TEST button will allow the unit to return to the address or OPEN message display routine.

Alternatively, a user can pull out the emergency HELP pull cord on the SSIU interface 38 which will initiate the sending of an emergency HELP signal to the body 12. The red power indicator led on the front of the SSIU will flash to indicate that the SSIU is attempting to send an emergency help signal to the body 12.

The user can test the alarm function by plugging a 9 volt battery into a 9 volt battery clip included in the interface 38. Touching a red lead wire of the battery clip to the positive plug input & a black lead wire of the battery clip to the ground plug input of the interface allows testing. It is not necessary to disconnect the wires from the alarm system. The blue LED indicator on the front of the SSIU will flash to indicate that the SSIU is attempting to send an emergency alarm signal to the body 12. The body 12 should display a flashing A-L-A-R message interspersed with the address indicating that the SSIU is sending an "ALARM" signal to the body 12. If looking at the status, display & operating mode LED indicator at the back of the body 12, all led indicators will flash each time the A-L-A-R message is displayed on the front of the body 12.

If the emergency HELP pull cord has been pulled out by the user, and an emergency alarm situation has been initiated by the connected residential or commercial alarm system at the same time, the emergency HELP message will be displayed. The red & blue indicator LED's at the front of the SSIU will alternately flash to indicate that both emergency situations exist but since the pull for emergency help has the highest priority, only the emergency HELP message will be displayed at the front of the body 12. If the user reinserts the pull for emergency help plug, the HELP message will be terminated and the alarm message (A-L-A-R) will commence.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

The invention claimed is:

1. A sign device arranged for displaying alpha-numeric information, the device comprising:

a unitary body surrounding a hollow interior, the unitary body comprising a front wall, a rear wall spaced apart from the front wall to define the hollow interior between the front wall and the rear wall, a top wall joined between the front wall and the rear across a top of the hollow interior and end walls joined between the front wall and the rear wall along opposing ends of the front wall and the rear wall such that the hollow interior of the unitary body is fully enclosed across the top and sides of the hollow interior so as to be weatherproof;

a display supported within the hollow interior and arranged to display illuminated alpha-numeric information;

the front wall of the unitary body comprising a display portion which is arranged to be translucent;

the display being operable between an active state in which the alpha-numeric information is externally visible through the display portion of the front wall of the unitary body and an inactive state in which the display is not visible through the display portion of the unitary body; and the display being arranged to display numerical address information in a numerical mode and display a text message in a text mode.

2. The device according to claim 1 wherein an entirety of an exterior surface of the body is textured and is arranged to resemble a natural rock when the display is in the inactive state.

3. The device according to claim 1 wherein a transmissivity of material forming the display portion is arranged to allow transmission of light from the display therethrough while arranging the light to be localized to a direct proximity to the display.

4. The device according to claim 1 wherein the display comprises high intensity light emitting diodes.

5. The device according to claim 1 wherein the display is substantially centered on the front wall and spans a majority of an area of the front wall.

6. The device according to claim 1 wherein the display is arranged to display information on the front wall in a plurality of different modes and wherein there is provided an indicator arranged to indicate on the rear wall which mode is being displayed on the front wall.

7. The device according to claim 6 wherein the indicator is arranged to display a plurality of different colours, each mode of the display on the front wall being associated with a different one of the colours arranged to be displayed by the indicator on the rear wall.

8. The device according to claim 1 wherein the display is operable in a first mode wherein the alphanumeric information is always visible and a second mode in which the alphanumeric information is only displayed when the body is in substantial darkness.

9. The device according to claim 1 wherein the display includes a plurality of different modes of information being displayed and wherein selection between the different modes is accomplished by a remote controller.

10. The device according to claim 1 wherein the display is arranged to be activated in a first mode in which the alphanumeric information is always displayed in a steady non-flashing condition and activated in a second mode in which the alpha-numeric information is displayed in a repeating non-steady illumination pattern.

11. The device according to claim 1 wherein there is provided a ground anchor arranged to be secured in the ground and arranged to be coupled to a bottom of the body in an interlocking connection.

12. The device according to claim 1 wherein there is provided an alarm arranged to indicate an alarm condition responsive to separation of the body from a supporting surface upon which the body rests in use.

13. The device according to claim 1 wherein the body is arranged to be supported externally from a building with which the display is arranged to be associated and the display is arranged to display an alarm condition responsive to an alarm trigger within the building.

14. The device according to claim 13 wherein the alarm trigger comprises a building alarm arranged to determine the alarm condition responsive to a fire or an unauthorized entry into the building.

15. The device according to claim 13 wherein the alarm trigger comprises a portable remote arranged to be carried by an occupant of the building.

16. The device according to claim 13 wherein the alarm trigger comprises an interface arranged for connection to a building alarm of a building, the interface having an auxiliary switch and being arranged to determine the alarm condition responsive to an alarm condition of the building alarm or responsive to activation of the auxiliary switch by an occupant of the building.

* * * * *